US011502383B2

(12) United States Patent
Ahadi et al.

(10) Patent No.: US 11,502,383 B2
(45) Date of Patent: Nov. 15, 2022

(54) EMNZ METAMATERIAL CONFIGURED INTO A WAVEGUIDE HAVING A LENGTH THAT IS LESS THAN OR EQUAL TO 0.1 OF A WAVELENGTH

(71) Applicants: Mehran Ahadi, Tehran (IR); Amir Jafargholi, Tehran (IR); Parviz Parvin, Tehran (IR)

(72) Inventors: Mehran Ahadi, Tehran (IR); Amir Jafargholi, Tehran (IR); Parviz Parvin, Tehran (IR)

(73) Assignee: AMIRKABIR UNIVERSITY OF TECHNOLOGY, Tehran (IR)

( * ) Notice: Subject to any disclaimer, the term of this patent is extended or adjusted under 35 U.S.C. 154(b) by 9 days.

(21) Appl. No.: 17/096,482

(22) Filed: Nov. 12, 2020

(65) Prior Publication Data

US 2021/0083396 A1 Mar. 18, 2021

Related U.S. Application Data

(60) Provisional application No. 62/934,012, filed on Nov. 12, 2019.

(51) Int. Cl.

| | |
|---|---|
| ***H01P 3/12*** | (2006.01) |
| ***H01P 7/10*** | (2006.01) |
| ***H01Q 15/00*** | (2006.01) |

(52) U.S. Cl.

CPC ..... *H01P 3/122* (2013.01); *H01P 7/10* (2013.01); *H01Q 15/0086* (2013.01)

(58) Field of Classification Search

CPC ..... H01P 3/122
USPC ..... 333/239
See application file for complete search history.

(56) References Cited

U.S. PATENT DOCUMENTS

| | | | | |
|---|---|---|---|---|
| 2,511,610 A * | 6/1950 | Wheeler | H01Q 19/08 | 333/243 |
| 6,794,960 B2 * | 9/2004 | Chiu et al. | H01P 1/181 | 333/239 |
| 2009/0174499 A1 * | 7/2009 | Hiramatsu et al. | H01P 1/18 | 333/139 |

OTHER PUBLICATIONS

"Parametric study on the use of magneto-dielectric materials for antenna miniaturization" by A. Louzir et al., published in 2010 IEEE Antennas and Propagation Society International Symposium, pp. 1-4. IEEE, 2010.

* cited by examiner

*Primary Examiner* — Benny T Lee
(74) *Attorney, Agent, or Firm* — Bajwa IP Law Firm; Haris Zaheer Bajwa

(57) ABSTRACT

An epsilon-and-mu-near-zero (EMNZ) metamaterial. The EMNZ metamaterial includes a waveguide. A length l of the waveguide satisfies a length condition according to $l \leq 0.1\lambda$, where $\lambda$ is an operating wavelength of the EMNZ metamaterial. The EMNZ metamaterial further includes a magneto-dielectric material deposited on a lower wall of the waveguide. The waveguide includes an impedance surface placed on the magneto-dielectric material.

20 Claims, 21 Drawing Sheets

202E

202B

202C

202D

202E

202F

EMNZ METAMATERIAL CONFIGURED INTO A WAVEGUIDE HAVING A LENGTH THAT IS LESS THAN OR EQUAL TO 0.1 OF A WAVELENGTH

CROSS-REFERENCE TO RELATED APPLICATION

This application claims the benefit of priority from U.S. Provisional Patent Application Ser. No. 62/934,012, filed on Nov. 12, 2019, and entitled "BROADBAND GUIDED STRUCTURE WITH NEAR-ZERO PERMITTIVITY, PERMEABILITY, AND REFRACTIVE INDEX," which is incorporated herein by reference in its entirety.

TECHNICAL FIELD

The present disclosure generally relates to metamaterials, and particularly, to epsilon-and-mu-near-zero (EMNZ) metamaterials with guided structure.

BACKGROUND

Metamaterials are artificial composites with physical characteristics that are not naturally available. Among physical characteristics, refractive index near-zero (INZ) characteristic is attractive to researchers and engineers because INZ metamaterials may transmit waves without altering phase of waves. As a result, a transient wave phase may remain constant when the transient wave travels in an INZ metamaterial. In other words, wavelengths of propagating waves in INZ metamaterials may tend to be infinite, making wave phase independent of waveguide dimensions and shape.

INZ metamaterials are divided into three categories: epsilon-near-zero (ENZ) metamaterials with near-zero permittivity coefficient, mu-near-zero (MNZ) metamaterials with near-zero permeability coefficient, and epsilon-and-mu-near-zero (EMNZ) metamaterials with near-zero permittivity and permeability coefficients. An application of ENZ or EMNZ metamaterials may include antenna design, where ENZ or EMNZ metamaterials are utilized for tailoring antenna radiation patterns, that is, to attain highly directive radiation patterns or enhancing a radiation efficiency. Metamaterials with near-zero parameters are also utilized for tunneling of electromagnetic energy within ultra-thin sub-wavelength ENZ channels or bends (a phenomenon referred to as super-coupling), tunneling through large volumes using MNZ structures, and to overcome weak coupling between different electromagnetic components that are conventionally not well matched, for example, for transition from a coaxial cable to a waveguide.

A permittivity and a permeability of a material may vary in different frequencies. As a result, an EMNZ metamaterial may exhibit near-zero characteristics, that is, near-zero permittivity and near-zero permeability, only in a specific frequency range. In contrast to appealing characteristics for use in microwave and antenna engineering, EMNZ metamaterials may suffer from very limited bandwidth, that is, near-zero characteristics may be attainable only in a limited frequency range, which may limit applications of EMNZ metamaterials with regards to microwave and antenna engineering. Moreover, for an EMNZ metamaterial, a frequency range with near-zero characteristics may not be adjustable, that is, a cutoff frequency of the EMNZ metamaterial may be constant. As a result, applications of the EMNZ metamaterial may be confined to a specific frequency range.

There is, therefore, a need for an EMNZ metamaterial exhibiting near-zero characteristics in a wide frequency range. There is also a need for an EMNZ metamaterial with an adjustable cutoff frequency.

SUMMARY OF THE INVENTION

This summary is intended to provide an overview of the subject matter of the present disclosure, and is not intended to identify essential elements or key elements of the subject matter, nor is it intended to be used to determine the scope of the claimed implementations. The proper scope of the present disclosure may be ascertained from the claims set forth below in view of the detailed description below and the drawings.

In one general aspect, the present disclosure describes an exemplary epsilon-and-mu-near-zero (EMNZ) metamaterial. An exemplary EMNZ metamaterial may include a waveguide. In an exemplary embodiment, a length l of the waveguide may satisfy a length condition according to $l \leq 0.1\lambda$, where $\lambda$ is an operating wavelength of the EMNZ metamaterial.

An exemplary waveguide may include one of a rectangular waveguide and a parallel-plate waveguide. An exemplary EMNZ metamaterial may further include a magneto-dielectric material. In an exemplary embodiment, the magneto-dielectric material may be deposited on a lower wall of the waveguide.

An exemplary waveguide may further include an impedance surface. An exemplary impedance surface may be placed on the magneto-dielectric material. In an exemplary embodiment, the impedance surface may include a tunable impedance surface. An exemplary tunable impedance surface may include a tunable conductivity.

An exemplary tunable impedance surface may include a graphene monolayer. In an exemplary embodiment, a dielectric spacer may be coated on the monolayer graphene and attached to an upper wall of the waveguide. In an exemplary embodiment, a thickness h of the dielectric spacer may satisfy a thickness condition according to $$h \leq \frac{\lambda}{4}.$$

In an exemplary embodiment, a permittivity of the dielectric spacer may be equal to a permittivity $\epsilon$ of the magneto-dielectric material. In an exemplary embodiment, a permeability of the dielectric spacer may be equal to a permeability $\mu$ of the magneto-dielectric material. An exemplary graphene monolayer may be attached to a left sidewall of the rectangular waveguide and a right sidewall of the rectangular waveguide.

An exemplary cutoff frequency $f_c$ may be configured to be adjusted by adjusting a chemical potential $\mu_c$ of the graphene monolayer. In an exemplary embodiment, cutoff frequency $f_c$ may be configured to be adjusted based on a distance between the upper wall and a lower wall of the waveguide and an effective permittivity of the magneto-dielectric material and the graphene monolayer.

Other exemplary systems, methods, features and advantages of the implementations will be, or will become, apparent to one of ordinary skill in the art upon examination of the following figures and detailed description. It is intended that all such additional systems, methods, features and advantages be included within this description and this summary, be within the scope of the implementations, and be protected by the claims herein.

BRIEF DESCRIPTION OF THE DRAWINGS

The drawing figures depict one or more implementations in accord with the present teachings, by way of example only, not by way of limitation. In the figures and in the detailed description, like reference numerals refer to the same or similar elements.

DETAILED DESCRIPTION OF THE INVENTION

Figure 1A:
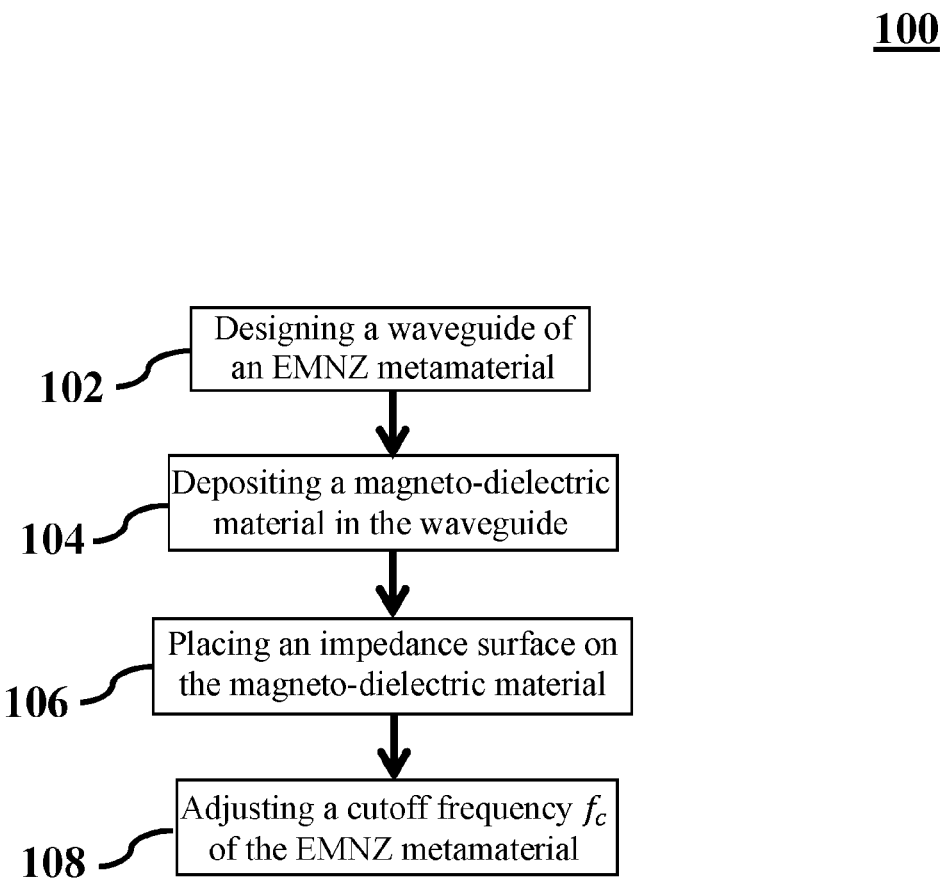
FIG. 1A shows a flowchart of a method for adjusting a cutoff frequency $f_c$ of an epsilon-and-mu-near-zero (EMNZ) metamaterial, consistent with one or more exemplary embodiments of the present disclosure.

In the following detailed description, numerous specific details are set forth by way of examples in order to provide a thorough understanding of the relevant teachings. However, it should be apparent that the present teachings may be practiced without such details. In other instances, well known methods, procedures, components, and/or circuitry have been described at a relatively high-level, without detail, in order to avoid unnecessarily obscuring aspects of the present teachings.

The following detailed description is presented to enable a person skilled in the art to make and use the methods and devices disclosed in exemplary embodiments of the present disclosure. For purposes of explanation, specific nomenclature is set forth to provide a thorough understanding of the present disclosure. However, it will be apparent to one skilled in the art that these specific details are not required to practice the disclosed exemplary embodiments. Descriptions of specific exemplary embodiments are provided only as representative examples. Various modifications to the exemplary implementations will be readily apparent to one skilled in the art, and the general principles defined herein may be applied to other implementations and applications without departing from the scope of the present disclosure. The present disclosure is not intended to be limited to the implementations shown, but is to be accorded the widest possible scope consistent with the principles and features disclosed herein.

Herein is disclosed an exemplary epsilon-and-mu-near-zero (EMNZ) metamaterial. Herein is also disclosed an exemplary method for adjusting a cutoff frequency of an exemplary EMNZ metamaterial. An exemplary EMNZ metamaterial may include a waveguide with a small length compared with an operating wavelength. At frequencies smaller than an exemplary cutoff frequency of the waveguide, an insertion loss of the waveguide may be negligible while the waveguide may exhibit near-zero characteristics. Some waveguide structures such as parallel-plate waveguides may not include a cutoff frequency, that is, a minimum frequency of an exemplary electromagnetic wave that may pass through a waveguide. As a result, parallel plate waveguides may not exhibit near-zero characteristics. In an exemplary embodiment, "near-zero characteristics" may refer to near-zero permittivity and near-zero permeability. Utilizing an impedance surface in a waveguide may change a propagation mode to a transverse magnetic (TM) propagation mode. As a result, a waveguide with an impedance surface may introduce a cutoff frequency. Therefore, utilizing an impedance surface, near-zero characteristics may be obtained in various waveguide structures.

A cutoff frequency may depend on geometric properties of a waveguide. As a result, a cutoff frequency of an exemplary EMNZ metamaterial constructed by a waveguide may be constant. To make the cutoff frequency adjustable, a tunable impedance surface may be utilized instead of a simple impedance surface. An exemplary tunable impedance surface may include an adjustable conductivity. Therefore, a cutoff frequency of the EMNZ metamaterial may be adjusted by adjusting a conductivity of a tunable impedance surface. An exemplary graphene monolayer may exhibit an appreciable impedance at Terahertz, visible light, and GHz frequency ranges. As a result, an exemplary graphene monolayer may be utilized as a tunable impedance surface. However, to benefit from using a graphene monolayer, the graphene monolayer may be separated from an upper wall of the waveguide by a dielectric spacer to avoid a short circuit.

FIG. 1A shows a flowchart of a method for adjusting a cutoff frequency $f_c$ of an EMNZ metamaterial, consistent with one or more exemplary embodiments of the present disclosure. In an exemplary embodiment, a method 100 may include designing a waveguide of an EMNZ metamaterial (step 102), depositing a magneto-dielectric material (step 104), placing an impedance surface on the magneto-dielectric material (step 106), and adjusting a cutoff frequency $f_c$ of the EMNZ metamaterial (step 108). In an exemplary embodiment, method 100 may be utilized to design an EMNZ metamaterial based on a waveguide. In an exemplary embodiment, method 100 may be further utilized for adjusting a cutoff frequency of the EMNZ metamaterial.

Figure 2A:
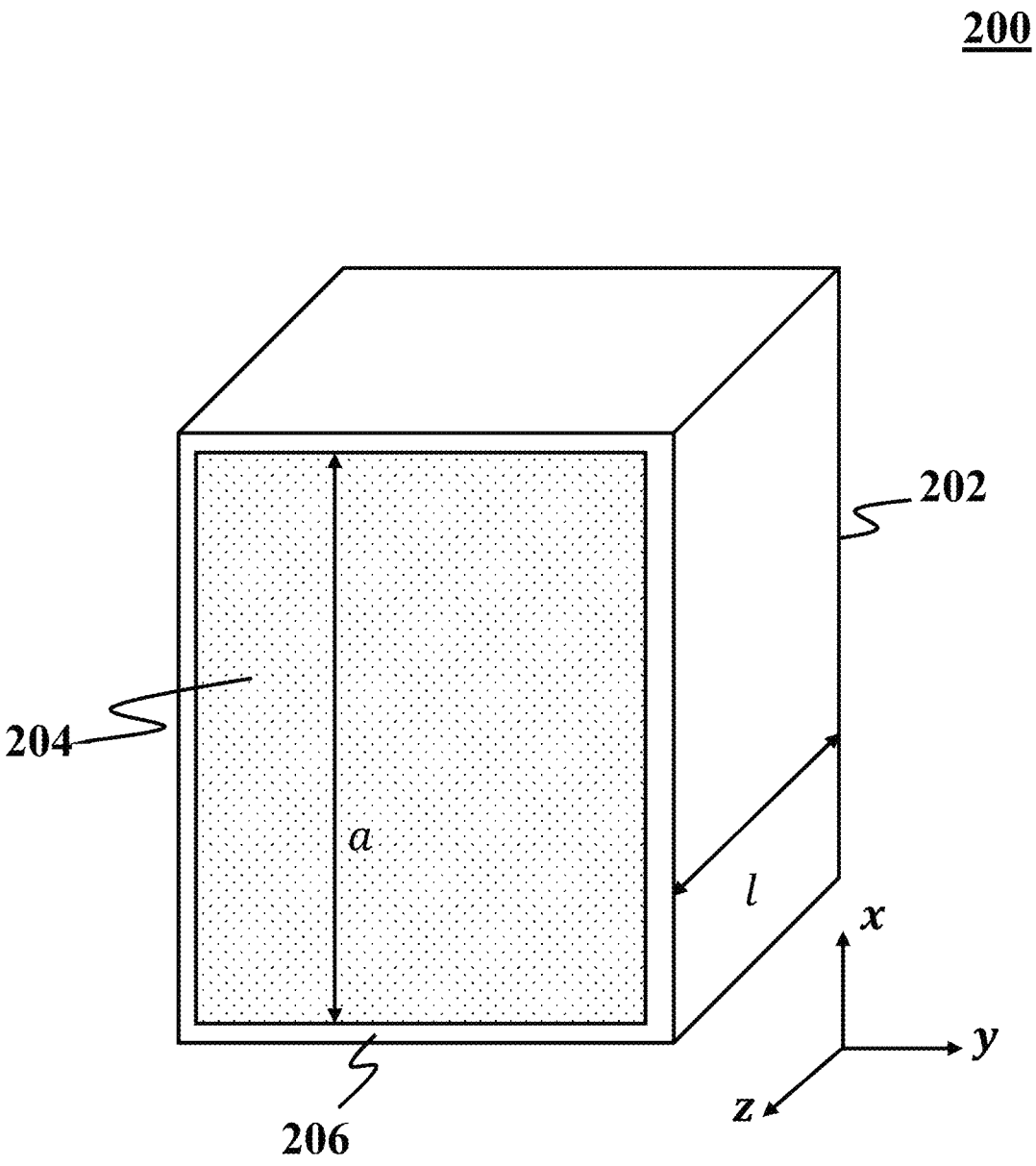
FIG. 2A shows a schematic of an EMNZ metamaterial, consistent with one or more exemplary embodiments of the present disclosure.

FIG. 2A shows a schematic of an EMNZ metamaterial, consistent with one or more exemplary embodiments of the present disclosure. In an exemplary embodiment, different steps of method 100 may be implemented utilizing an EMNZ metamaterial 200. In an exemplary embodiment, EMNZ metamaterial 200 may include a waveguide 202 and a magneto-dielectric material 204. An exemplary orientation of EMNZ metamaterial 200 is shown in FIG. 2A with respect to horizontal (x), vertical (y), and out of plane (z) directions.

In an exemplary embodiment, step 102 in FIG. 1A may include designing waveguide 202 by determining a length l of waveguide 202. In an exemplary embodiment, length l may be determined based on a length condition defined by $l \leq 0.1\lambda$, where $\lambda$ is an operating wavelength of EMNZ metamaterial 200. In an exemplary embodiment, length l may refer to a length of a path that a wave may travel in waveguide 202, that is, a length of waveguide 202 along the z direction. In an exemplary embodiment, an ability of waveguide 202 for passing a wave may depend on a size of a cross-section of waveguide 202 and a wavelength of the wave. In an exemplary embodiment, when a wavelength of a wave is larger than a threshold, an insertion loss of waveguide 202 may be very large, that is, the wave may not pass through waveguide 202. An exemplary threshold may refer to a "cutoff wavelength" (or consistently, a "cutoff frequency") of waveguide 202. On the other hand, in an exemplary embodiment, an effective permittivity and an effective permeability of waveguide 202 may be near-zero in frequencies smaller than the cutoff frequency. As a result, waveguide 202 may act as an EMNZ metamaterial in frequencies smaller than the cutoff frequency. However, an energy of an exemplary wave with a frequency smaller than the cutoff frequency may be significantly decreased due to high insertion loss. An exemplary insertion loss of waveguide 202 for frequencies smaller than the cutoff frequency may depend on length l, that is, the insertion loss may be larger for larger values of length l. As a result, in an exemplary embodiment, when length l is very small compared with a wavelength of a passing wave, the insertion loss may become small and the passing wave may pass through waveguide 202 without a significant energy dissipation. As a result, in an exemplary embodiment, waveguide 202 with a small length, that is $l \leq 0.1\lambda$, may act as an EMNZ metamaterial at frequencies smaller than the cutoff frequency.

Figure 2B:
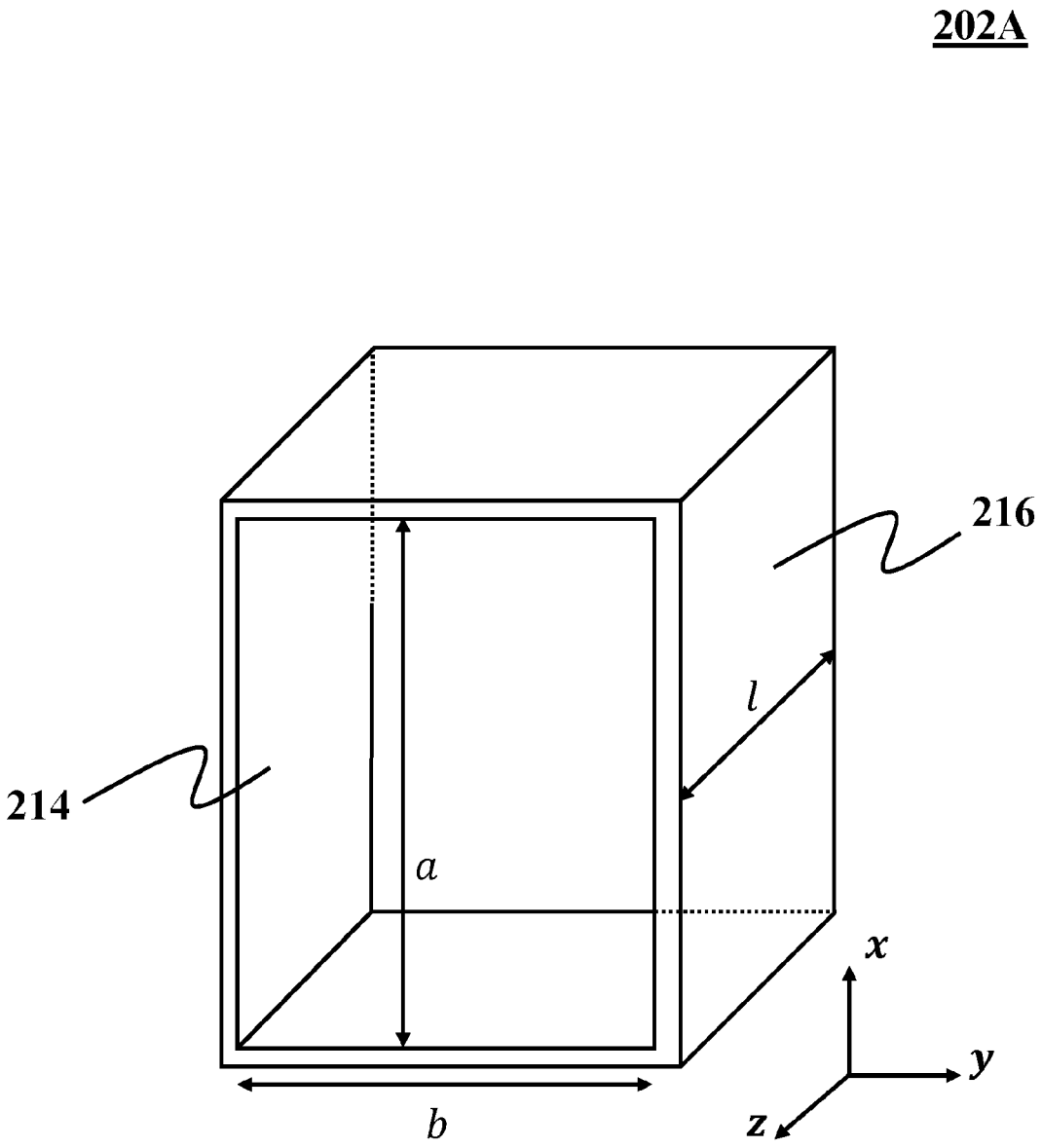
FIG. 2B shows a schematic of a rectangular waveguide, consistent with one or more exemplary embodiments of the present disclosure.
Figure 2C:
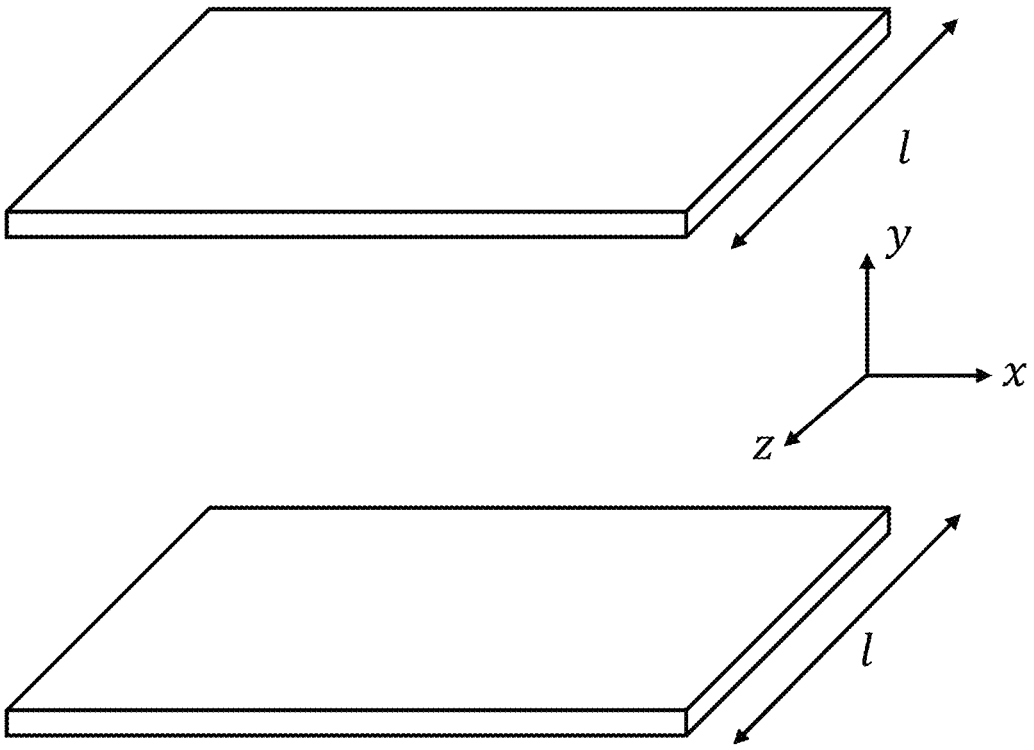
FIG. 2C shows a schematic of a parallel-plate waveguide, consistent with one or more exemplary embodiments of the present disclosure.

FIG. 2B shows a schematic of a rectangular waveguide, consistent with one or more exemplary embodiments of the present disclosure. FIG. 2C shows a schematic of a parallel-plate waveguide, consistent with one or more exemplary embodiments of the present disclosure. Referring to FIGS. 2A-2C, in an exemplary embodiment, designing waveguide 202 in step 102 in FIG. 1A may include designing one of a rectangular waveguide 202A and a parallel-plate waveguide 202B. In an exemplary embodiment, rectangular waveguide 202A in FIG. 2B may include a first implementation of waveguide 202. In an exemplary embodiment, parallel-plate waveguide 202B in FIG. 2C may include a second implementation of waveguide 202. In an exemplary embodiment, parallel-plate waveguide 202B may be infinitely extended in the x direction.

In an exemplary embodiment, as shown in FIG. 2A, step 104 in FIG. 1A may include depositing magneto-dielectric material 204. In an exemplary embodiment, magneto-dielectric material 204 may be deposited on a lower wall 206 of waveguide 202 by deposition techniques such as chemical deposition and physical deposition. In an exemplary embodiment, chemical deposition may cause a chemical change in a fluid on a solid surface, resulting in a solid layer. In an exemplary embodiment, physical deposition may utilize mechanical, electromechanical or thermodynamic means to produce a solid layer. In an exemplary embodiment, waveguide 202 may be filled by depositing magneto-dielectric material 204. In an exemplary embodiment, a cutoff frequency of waveguide 202 may depend on a permittivity and a permeability of magneto-dielectric material 204. In an exemplary embodiment, as shown in FIG. 2B, a cutoff frequency of rectangular waveguide 202A may be given according to an operation defined by:

$$f_c = \frac{1}{2d\sqrt{\mu_0 \epsilon}} \qquad \text{Equation (1)}$$

where d=max {a, b}, a is a height of rectangular waveguide 202A, b is a width of rectangular waveguide 202A, $\mu_0$ is a permeability of free space, and $\epsilon$ is a permittivity of magneto-dielectric material 204.

Figure 2D:
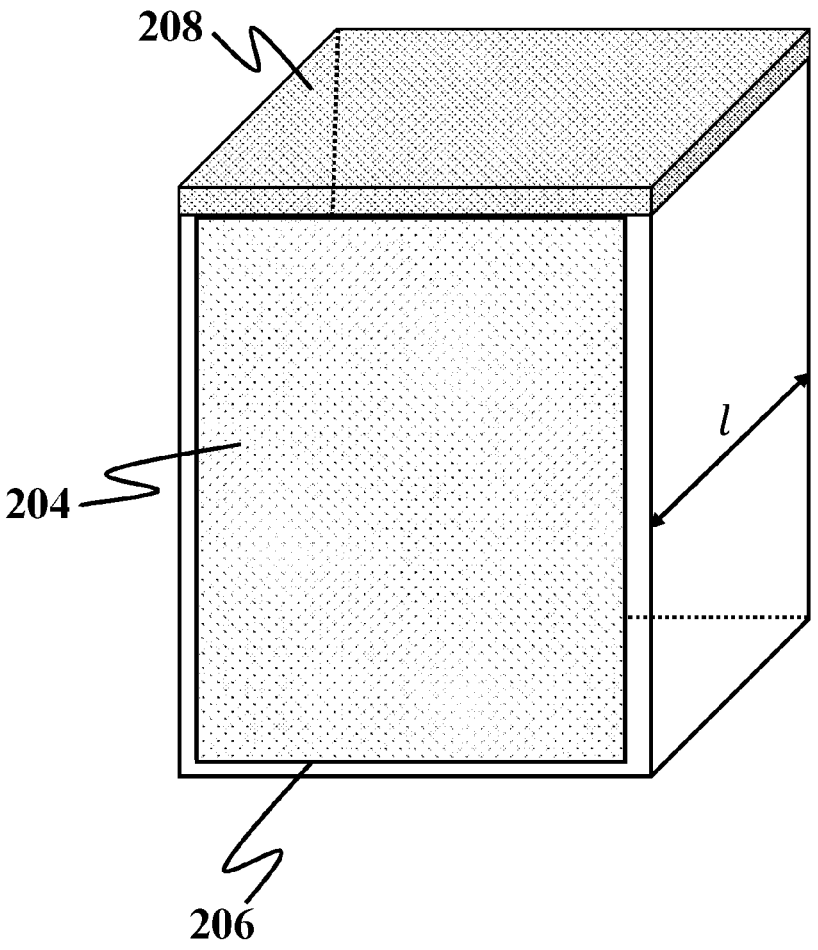
FIG. 2D shows a schematic of an impedance surface waveguide, consistent with one or more exemplary embodiments of the present disclosure.

FIG. 2D shows a schematic of an impedance surface waveguide, consistent with one or more exemplary embodiments of the present disclosure. In an exemplary embodiment, an impedance surface waveguide 202C may include a third implementation of waveguide 202. In an exemplary embodiment, impedance surface waveguide 202C may include an impedance surface 208.

In an exemplary embodiment, as shown in FIG. 2D, step 106 in FIG. 1A may include placing impedance surface 208 on magneto-dielectric material 204. In an exemplary embodiment, impedance surface 208 may operate as an upper wall of impedance surface waveguide 202C. In an exemplary embodiment, placing impedance surface 208 may change a transverse electric (TE) propagation mode in waveguide 202 in FIG. 2A to a TM propagation mode in impedance surface waveguide 202C in FIG. 2D.

Figure 2E:
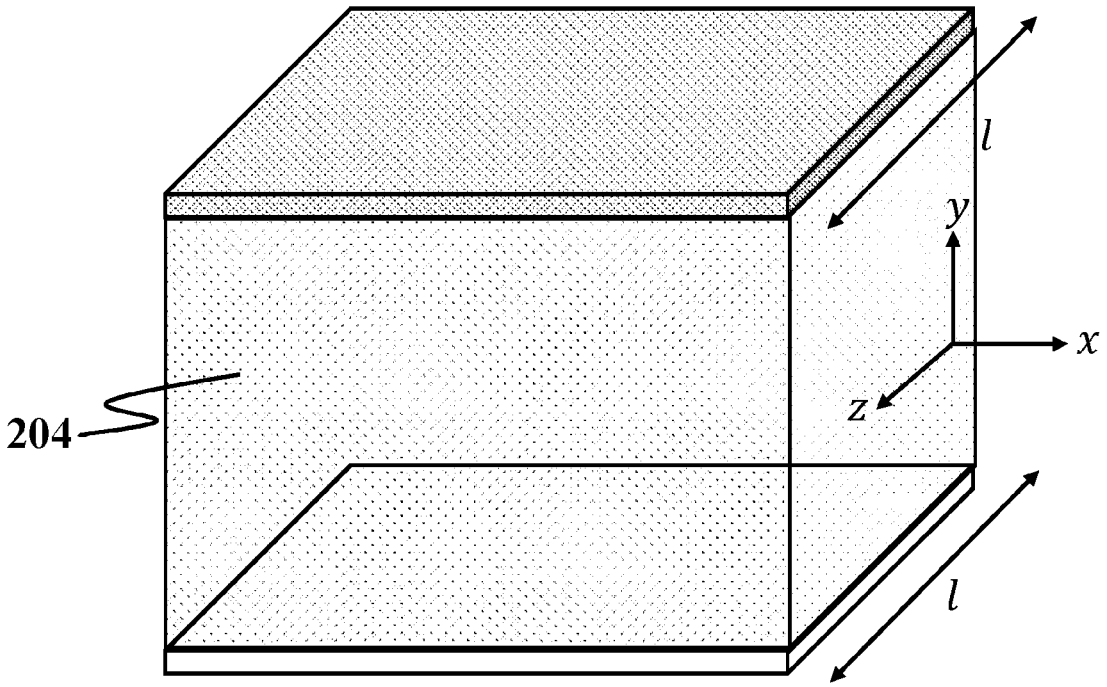
FIG. 2E shows a schematic of an impedance surface parallel-plate waveguide, consistent with one or more exemplary embodiments of the present disclosure.

FIG. 2E shows a schematic of an impedance surface parallel-plate waveguide, consistent with one or more exemplary embodiments of the present disclosure. In an exemplary embodiment, an impedance surface parallel-plate waveguide 202D may be obtained by placing an impedance surface on magneto-dielectric material 204. In an exemplary embodiment, impedance surface parallel-plate waveguide 202D may be an exemplary implementation of parallel-plate waveguide 202B in FIG. 2C. In an exemplary embodiment, parallel-plate waveguide 202B may not include a cutoff frequency in a dominant transverse electromagnetic (TEM) propagation mode. In an exemplary embodiment, placing impedance surface 208 may change a propagation mode of a passing wave in parallel-plate waveguide 202B in FIG. 2C to a TM propagation mode in impedance surface parallel-plate waveguide 202D in FIG. 2E. As a result, a cutoff frequency may be introduced for a dominant TM propagation mode in impedance surface parallel-plate waveguide 202D and impedance surface parallel-plate waveguide 202D may operate as an EMNZ metamaterial in frequencies smaller than the cutoff frequency.

Figure 3A:
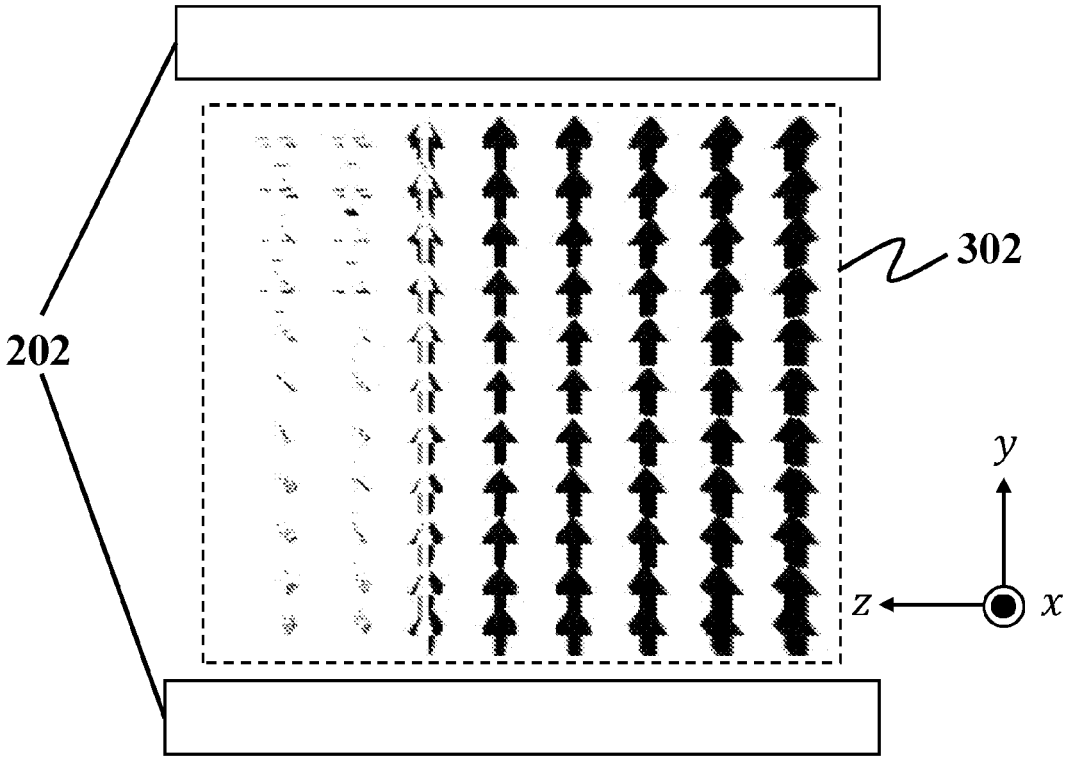
FIG. 3A shows an electric field in a side view of a waveguide, consistent with one or more exemplary embodiments of the present disclosure.

FIG. 3A shows an electric field in a side view of a waveguide, consistent with one or more exemplary embodiments of the present disclosure. In an exemplary embodiment, a first electric field 302 of a passing wave in waveguide 202 may be perpendicular to a direction of propagation, that is, z direction (first electric field 302 is more intense in points with darker electric field arrows). An exemplary passing wave may include a TE propagation mode in waveguide 202 with a cutoff frequency according to Equation (1).

Figure 3B:
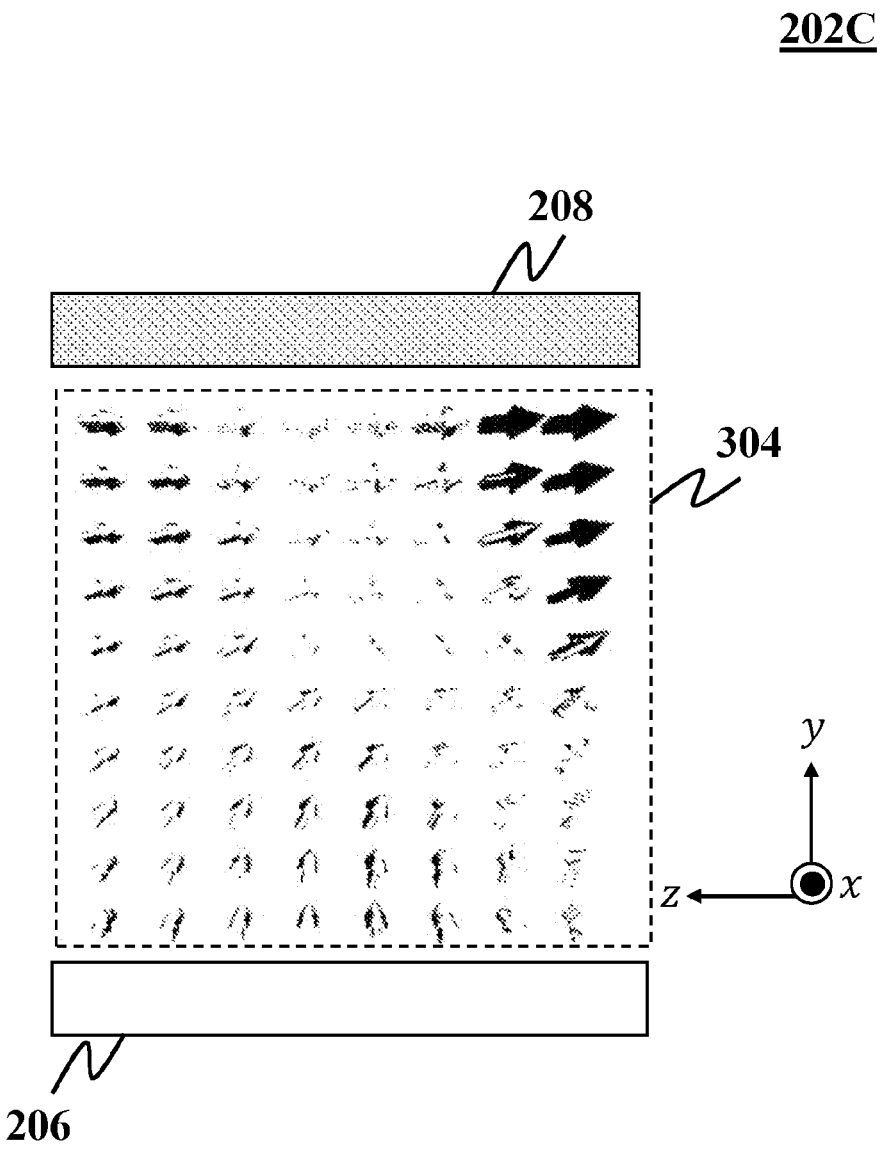
FIG. 3B shows an electric field in a side view of an impedance surface waveguide, consistent with one or more exemplary embodiments of the present disclosure.

FIG. 3B shows an electric field in a side view of an impedance surface waveguide, consistent with one or more exemplary embodiments of the present disclosure. In an exemplary embodiment, placing impedance surface 208 may impose an impedance boundary condition on a passing wave through impedance surface waveguide 202C (shown from a side view in FIG. 2D). As a result, in an exemplary embodiment, a second electric field 304 of a passing wave in impedance surface waveguide 202C may be parallel with impedance surface 208 (second electric field 304 is more intense in points with darker electric field arrows). In an exemplary embodiment, second electric field 304 may not be perpendicular to z direction. In an exemplary embodiment, second electric field 304 may show an electric field of a passing wave in a TM propagation mode. As a result, in an exemplary embodiment, placing impedance surface 208 may change a propagation mode from a TE propagation mode to a TM propagation mode.

Referring again to FIGS. 1A and 2A, in an exemplary embodiment, placing impedance surface 208 in step 106 in FIG. 1A may include placing a tunable impedance surface. An exemplary tunable impedance surface may include a tunable conductivity. An exemplary tunable impedance surface may include an artificial structure imposing an impedance boundary condition on a passing wave. Moreover, a tunable impedance surface may be electrically tuned to exhibit different values of surface impedances. An exemplary tunable impedance surface may be tuned by applying an electric potential to the tunable impedance surface. In an exemplary embodiment, a desired surface impedance of the tunable impedance surface may be obtained by applying an electric potential related to the desired surface impedance. In an exemplary embodiment, a relation between different electric potential values and resulting surface impedances of the tunable impedance surface may be obtained empirically. In an exemplary embodiment, by tuning the tunable impedance surface to each value of surface impedance a respective cutoff frequency of EMNZ metamaterial 200 may be obtained. As a result, in an exemplary embodiment, a cutoff frequency of EMNZ metamaterial 200 may be adjusted by tuning the tunable impedance surface to exhibit a respective surface impedance to the cutoff frequency. In an exemplary embodiment, a relation between different values of surface impedances and respective cutoff frequencies for each surface impedance may be obtained empirically.

Figure 1B:
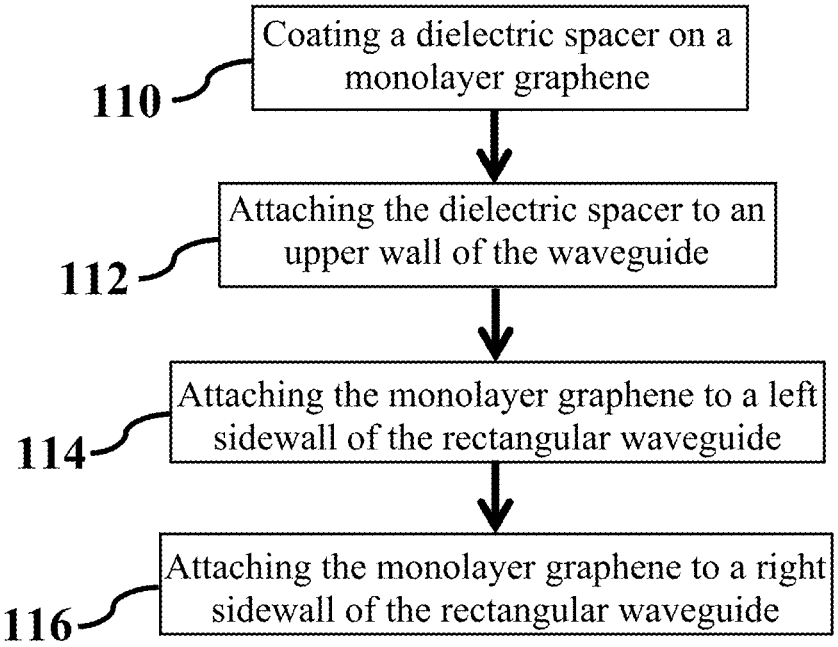
FIG. 1B shows a flowchart of a method for placing a graphene monolayer on a magneto-dielectric material, consistent with one or more exemplary embodiments of the present disclosure.

FIG. 1B shows a flowchart of a method for placing a graphene monolayer on a magneto-dielectric material, consistent with one or more exemplary embodiments of the present disclosure. Specifically, FIG. 1B shows exemplary details of step 106. In an exemplary embodiment, placing the tunable impedance surface on magneto-dielectric material 204 may include placing a graphene monolayer on magneto-dielectric material 204. In an exemplary embodiment, placing the graphene monolayer may include coating a dielectric spacer on the graphene monolayer (step 110), attaching the dielectric spacer to an upper wall of a graphene-loaded waveguide (step 112), attaching graphene monolayer 210 to a left sidewall of the rectangular waveguide (step 114), and attaching graphene monolayer 210 to a right sidewall of the rectangular waveguide (step 116).

Figure 2F:
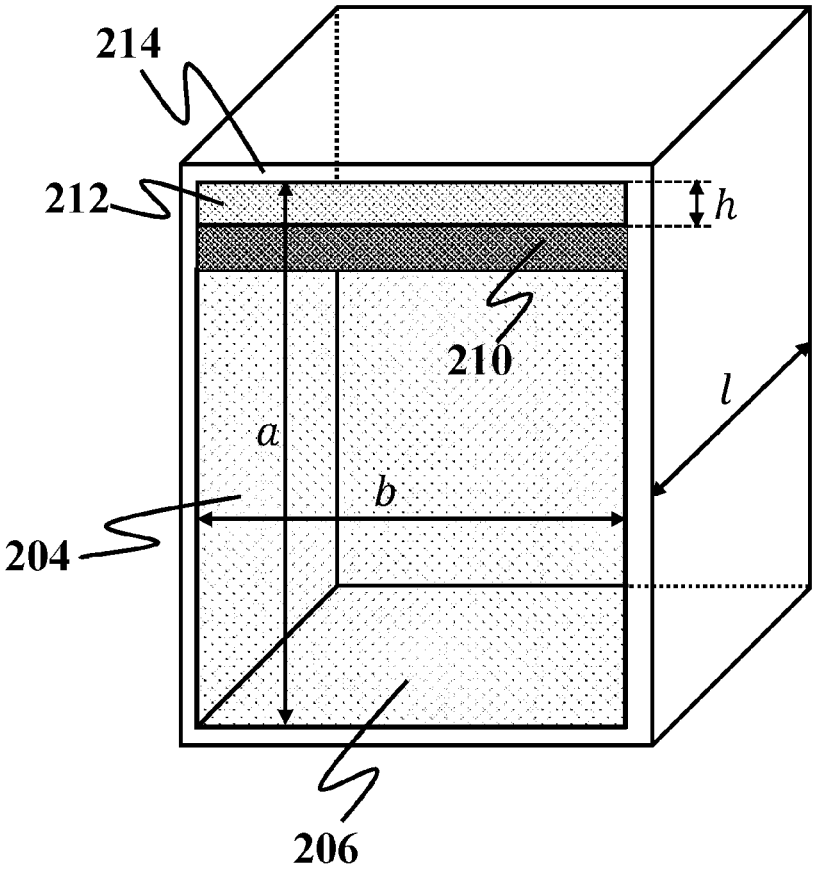
FIG. 2F shows a schematic of a graphene-loaded waveguide, consistent with one or more exemplary embodiments of the present disclosure.

FIG. 2F shows a schematic of a graphene-loaded waveguide, consistent with one or more exemplary embodiments of the present disclosure. In an exemplary embodiment, a graphene-loaded waveguide 202E may include a fourth implementation of waveguide 202. In an exemplary embodiment, different steps of flowchart 106 in FIG. 1B may be implemented utilizing graphene-loaded waveguide 202E. In an exemplary embodiment, graphene-loaded waveguide 202E may include a graphene monolayer 210 and a dielectric spacer 212. In an exemplary embodiment, a permittivity of dielectric spacer 212 may be equal to a permittivity E of magneto-dielectric material 204. In an exemplary embodiment, a permeability of dielectric spacer 212 may be equal to a permeability μ of magneto-dielectric material 204. In an exemplary embodiment, monolayer graphene monolayer 210 may exhibit various surface impedances in different frequency bands. In an exemplary embodiment, a surface impedance of graphene monolayer 210 may change a propagation mode to a TM propagation mode in various frequency bands including visible light, terahertz, and gigahertz frequency bands. As a result, graphene-loaded waveguide 202E may exhibit EMNZ characteristic in visible light, terahertz, and gigahertz frequency bands. In an exemplary embodiment, a surface impedance of graphene monolayer 210 may depend on a value of a chemical potential of graphene monolayer 210. As a result, a surface impedance of graphene monolayer 210 may be adjusted by adjusting a chemical potential of the graphene monolayer. In an exemplary embodiment, a chemical potential of graphene monolayer 210 may depend on an electric potential applied to graphene monolayer 210. As a result, an exemplary chemical potential of graphene monolayer 210 may be adjusted by adjusting an electric potential applied to graphene monolayer 210. An exemplary electric potential applied to graphene monolayer may include a direct current (DC) electric potential. In an exemplary embodiment, graphene monolayer 210 may exhibit a specific surface impedance by applying a respective electric potential to graphene monolayer 210. An exemplary electric potential may be applied to graphene monolayer 210 by connecting graphene monolayer 210 to a DC power supply node. In an exemplary embodiment, graphene monolayer 210 may include a single atomic layer of graphite. In an exemplary embodiment, when a thickness of graphene monolayer 210 is large, graphene monolayer 210 may turn to a graphene plasmon. As a result, graphene monolayer 210 may not impose an impedance surface boundary condition on a passing wave in graphene-loaded waveguide 202E, and consequently, graphene-loaded waveguide 202E may not exhibit EMNZ characteristics.

Referring again to FIGS. 1B and 2F, in an exemplary embodiment, step 110 in FIG. 1B may include coating a dielectric spacer 212 on a graphene monolayer 210. In an exemplary embodiment, coating dielectric spacer 212 may include determining a thickness h (FIG. 2F) of dielectric spacer 212. In an exemplary embodiment, the thickness h may be determined based on a thickness condition defined by $$h \leq \frac{\lambda}{4}.$$

In an exemplary embodiment, when thickness h is large compared with operating wavelength λ, a combination of graphene monolayer 210 and dielectric spacer 212 may not impose an impedance surface boundary condition, and consequently, a propagation mode may not change to a TM mode. As a result, in an exemplary embodiment, graphene-loaded waveguide 202E may not exhibit EMNZ characteristics.

In an exemplary embodiment, step 112 in FIG. 1B may include directly attaching dielectric spacer 212 to an upper wall 214 of graphene-loaded waveguide 202E in FIG. 2F. As a result, in an exemplary embodiment, dielectric spacer 212 may be positioned between upper wall 214 and graphene monolayer 210. Otherwise, in an exemplary embodiment, graphene monolayer 210 may be short-circuited with upper wall 214. As a result, graphene monolayer 210 may not impose an impedance surface boundary condition on a passing wave in graphene-loaded waveguide 202E. In an exemplary embodiment, dielectric spacer 212 may avoid graphene monolayer 210 to be short-circuited with upper wall 214.

Figure 2G:
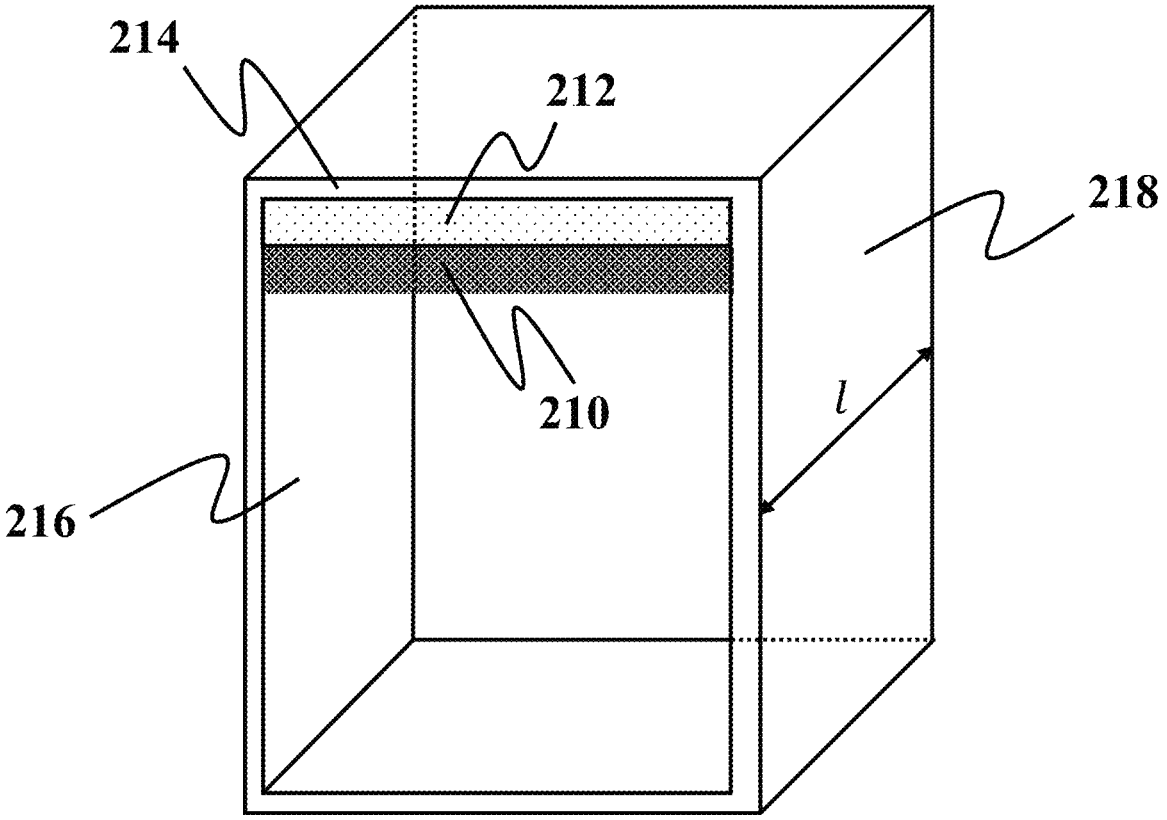
FIG. 2G shows a schematic of a graphene-loaded rectangular waveguide, consistent with one or more exemplary embodiments of the present disclosure.

FIG. 2G shows a schematic of a graphene-loaded rectangular waveguide, consistent with one or more exemplary embodiments of the present disclosure. In an exemplary embodiment, a graphene-loaded rectangular waveguide 202F may include an exemplary implementation of graphene-loaded waveguide 202E. In an exemplary embodiment, different steps of flowchart 106 in FIG. 1B may be implemented utilizing graphene-loaded rectangular waveguide 202F. In an exemplary embodiment, step 114 in FIG. 1B may include directly attaching graphene monolayer 210 to a left sidewall 216 of graphene-loaded rectangular waveguide 202F. In an exemplary embodiment, an impedance surface boundary condition may be imposed on a passing wave over entire of upper wall 214. As a result, graphene monolayer 210 may cover entire of upper wall 214. In an exemplary embodiment, graphene monolayer 210 may be directly attached to left sidewall 216 to ensure imposing the impedance surface boundary condition over entire of upper wall 214.

Referring again to FIGS. 1B and 2G, in an exemplary embodiment, step 116 in FIG. 1B may include directly attaching graphene monolayer 210 to a right sidewall 218 of graphene-loaded rectangular waveguide 202F. In an exemplary embodiment, an impedance surface boundary condition may be imposed on a passing wave over entire of upper wall 214. As a result, graphene monolayer 210 may cover entire of upper wall 214. In an exemplary embodiment, graphene monolayer 210 may be directly attached to right sidewall 218 to ensure imposing the impedance surface boundary condition over entire of upper wall 214.

In an exemplary embodiment, step 108 in FIG. 1A may include adjusting cutoff frequency $f_c$. In an exemplary embodiment, the cutoff frequency may be adjusted by adjusting a chemical potential $\mu_c$ of graphene monolayer 210. An exemplary chemical potential may be adjusted according to an operation defined by:

$$f_c = \frac{1}{4a\sqrt{\mu\epsilon_{eff}}} \qquad \text{Equation (2)}$$

where α is a distance between upper wall 214 and lower wall 206, u is the permeability of the magneto-dielectric material and $\epsilon_{eff}$ is an effective permittivity of magneto-dielectric material 204 and graphene monolayer 210, where $\epsilon_{eff}=\epsilon(1-165\sqrt{\alpha}\mu_c)$. In an exemplary embodiment, chemical potential $\mu_c$ of graphene monolayer 210 may be adjusted by applying a respective DC electric potential to graphene monolayer 210. In an exemplary embodiment, a relation between chemical potential $\mu_c$ of graphene monolayer 210 and a respective DC electric potential may be obtained empirically.

EXAMPLE 1

In this example, a performance of a method (similar to method 100) for adjusting a cutoff frequency of an EMNZ metamaterial (similar to EMNZ metamaterial 200) in terahertz frequency range is demonstrated. Different steps of the method are implemented utilizing an EMNZ metamaterial similar to EMNZ metamaterial 200. The EMNZ metamaterial includes a graphene-loaded waveguide (similar to graphene-loaded waveguide 202E). The EMNZ metamaterial includes a magneto-dielectric material (similar to magneto-dielectric material 204) with a permittivity about ∈=2. A length l of the graphene-loaded waveguide (similar to length l) is about l=0.1 μm. A height of the graphene-loaded waveguide (similar to distance α) is about α=2 μm. A width of the graphene-loaded waveguide (similar to a distance b in FIG. 2E) is about b=5 μm.

Figure 4:
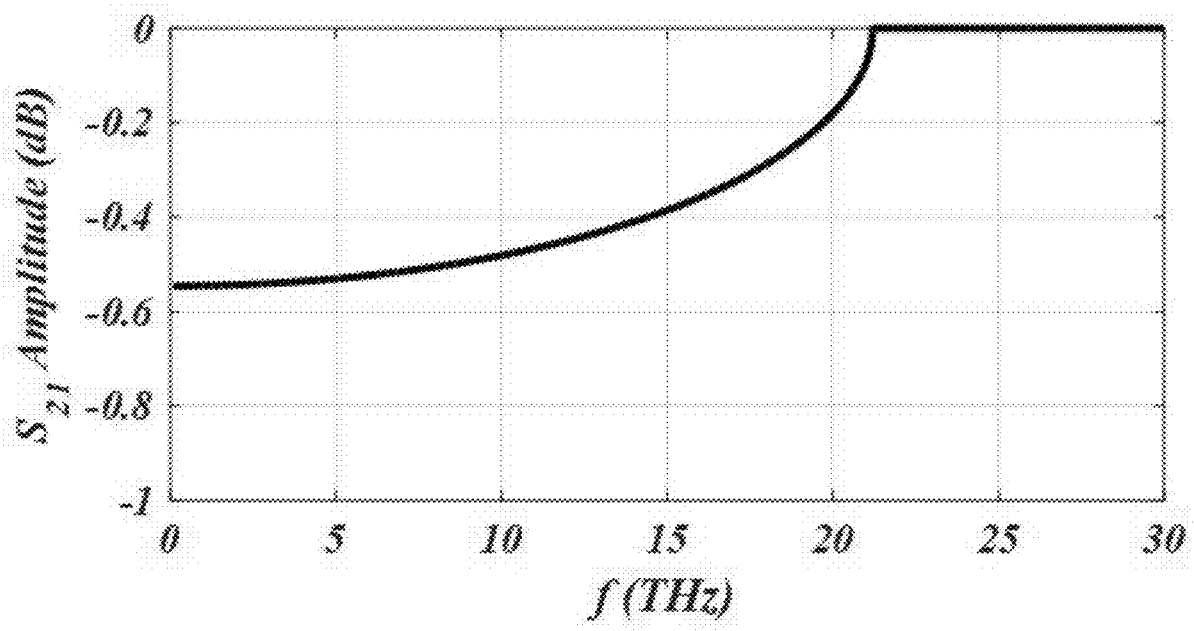
FIG. 4 shows an insertion loss of an EMNZ metamaterial in a terahertz frequency range, consistent with one or more exemplary embodiments of the present disclosure.

FIG. 4 shows an insertion loss of an EMNZ metamaterial in a terahertz (THz) frequency range, consistent with one or more exemplary embodiments of the present disclosure. Amplitude variations of an insertion loss $S_{21}$ of the EMNZ metamaterial versus frequency (f) are depicted in decibels (dB) in FIG. 4. An exemplary cutoff frequency (similar to cutoff frequency $f_c$) of the EMNZ metamaterial is about 21 THz. An insertion loss of the EMNZ metamaterial is less than about 0.6 dB in frequencies less than about 21 THz. As a result, a passing wave with a frequency less than about 21 THz may pass through the EMNZ metamaterial with a low amount of energy dissipation.

Figure 5:
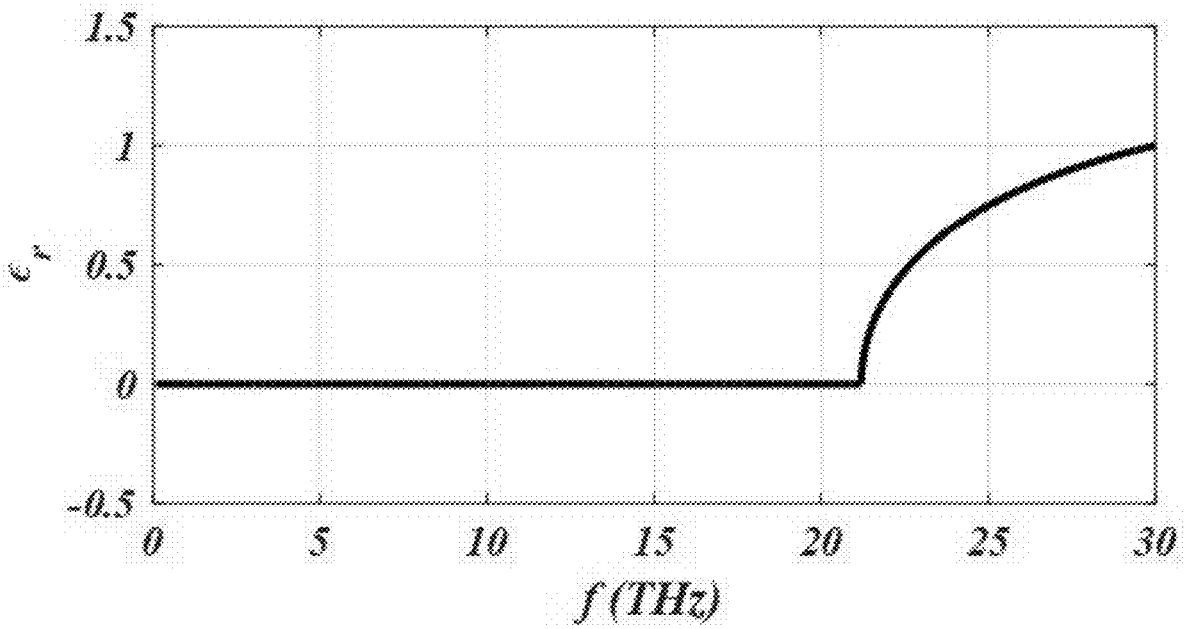
FIG. 5 shows an effective permittivity of an EMNZ metamaterial in a terahertz frequency range, consistent with one or more exemplary embodiments of the present disclosure.

FIG. 5 shows an effective permittivity $\epsilon_r$ of an EMNZ metamaterial in a terahertz (THz) frequency range, consistent with one or more exemplary embodiments of the present disclosure. An exemplary effective permittivity $\epsilon_r$ of the EMNZ metamaterial is about to zero in frequencies less than about 21 THz. In other words, a passing wave with a frequency f less than about 21 THz experiences an epsilon-near-zero (ENZ) medium when passes through the EMNZ metamaterial. In frequencies larger than about 21 THz, however, effective permittivity $\epsilon_r$ of the EMNZ metamaterial increases. As a result, the EMNZ metamaterial does not exhibit ENZ characteristics in frequencies larger than about 21 THz.

Figure 6:
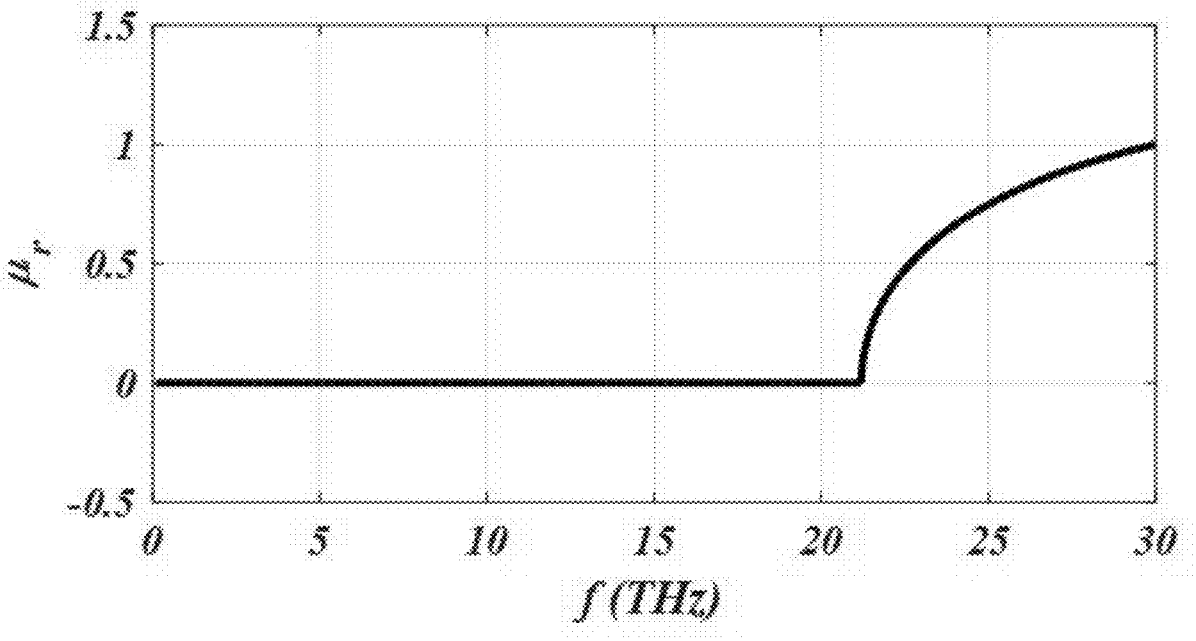
FIG. 6 shows an effective permeability of an EMNZ metamaterial in a terahertz frequency range, consistent with one or more exemplary embodiments of the present disclosure.

FIG. 6 shows an effective permeability of an EMNZ metamaterial in a terahertz (THz) frequency range, consistent with one or more exemplary embodiments of the present disclosure. An exemplary effective permeability $\mu_r$ of the EMNZ metamaterial is about to zero in frequencies less than about 21 THz. In other words, a passing wave with a frequency less than about 21 THz experiences a mu-near-zero (MNZ) medium when the wave passes through the EMNZ metamaterial. In frequencies larger than about 21 THz, however, effective permeability $\mu_r$ of the EMNZ metamaterial increases. As a result, the EMNZ metamaterial does not exhibit MNZ characteristics in frequencies larger than about 21 THz.

EXAMPLE 2

In this example, a performance of a method (similar to method 100) for adjusting a cutoff frequency of an EMNZ metamaterial (similar to EMNZ metamaterial 200) in terahertz frequency range is demonstrated. Different steps of the method are implemented utilizing an EMNZ metamaterial similar to EMNZ metamaterial 200. The EMNZ metamaterial includes a graphene-loaded waveguide (similar to graphene-loaded waveguide 202E). The EMNZ metamaterial includes a magneto-dielectric material (similar to magneto-dielectric material 204) with a permittivity about $\epsilon$=2. A length l of the graphene-loaded waveguide (similar to length l) is about l=1 nm. A height of the graphene-loaded waveguide (similar to distance $\alpha$) is about $\alpha$=40 nm. A chemical potential (similar to chemical potential $\mu_c$) of a graphene monolayer (similar to graphene monolayer 210) is about 0 electron-volt (eV).

Figure 7:
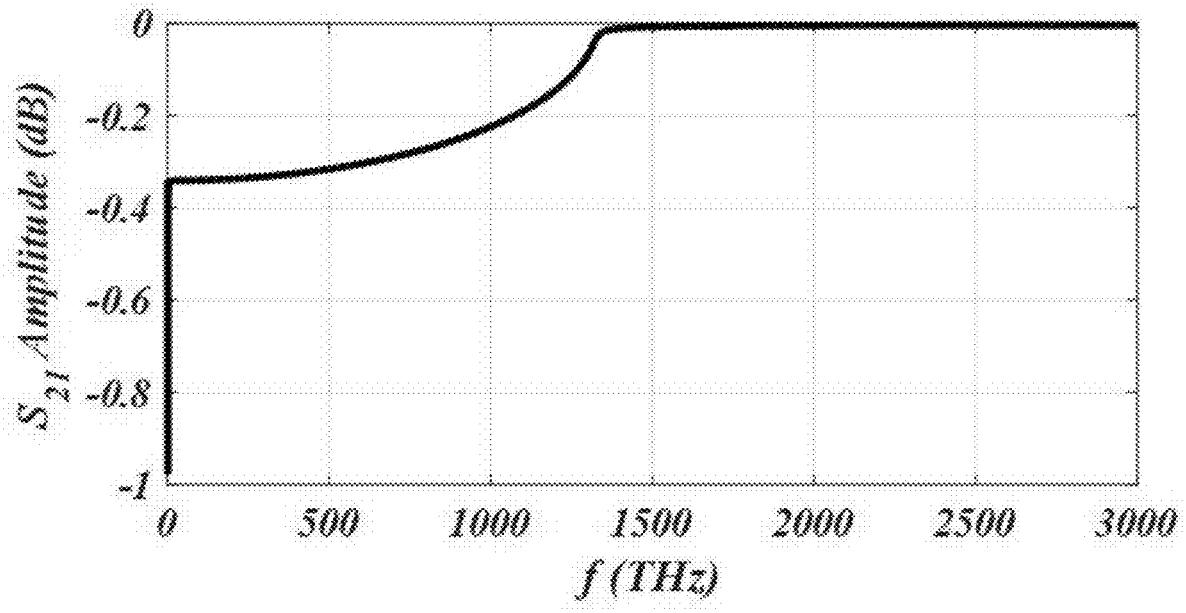
FIG. 7 shows an insertion loss of an EMNZ metamaterial in a visible light frequency range, consistent with one or more exemplary embodiments of the present disclosure.

FIG. 7 shows an insertion loss of an EMNZ metamaterial in a visible light frequency range, consistent with one or more exemplary embodiments of the present disclosure. Amplitude variations of an insertion loss $S_{21}$ of the EMNZ metamaterial in different frequencies are depicted in decibels (dB) in FIG. 7. An exemplary cutoff frequency (similar to cutoff frequency $f_c$) of the EMNZ metamaterial is about 1300 THz. An insertion loss amplitude of the EMNZ metamaterial decreases from about 1 dB to less than about 0.4 dB in a very narrow frequency range (from 0 to about 2 THz, demonstrated by an almost vertical line at the left edge of the diagram of FIG. 7), and remains less than about 0.4 dB in frequencies less than about 1300 THz. As a result, a passing wave with a frequency f in a range of about 2 THz to less than about 1300 THz may pass through the EMNZ metamaterial with a low amount of energy dissipation.

Figure 8:
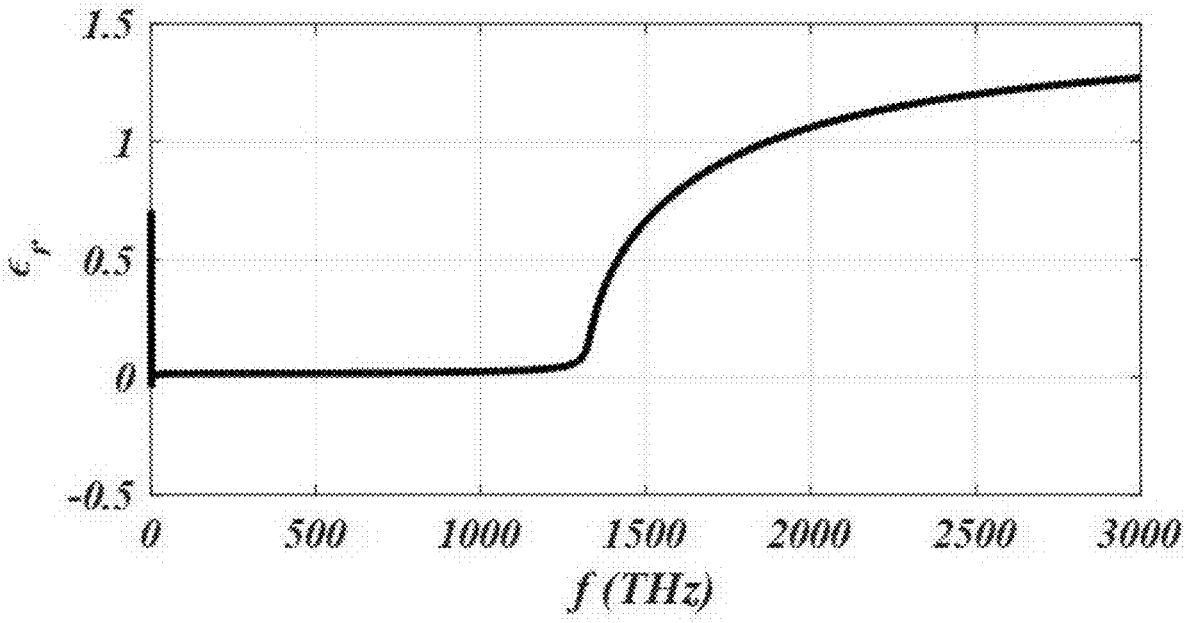
FIG. 8 shows an effective permittivity of an EMNZ metamaterial in a visible light frequency range, consistent with one or more exemplary embodiments of the present disclosure.

FIG. 8 shows an effective permittivity of an EMNZ metamaterial in a visible light frequency range, consistent with one or more exemplary embodiments of the present disclosure. An exemplary effective permittivity $\epsilon_r$ of the EMNZ metamaterial decreases from more than 0.5 to about 0 in a very narrow frequency range (from 0 to about 2 THz, demonstrated by an almost vertical line at the left edge of the diagram of FIG. 8), and remains about zero in frequencies less than about 1300 THz. In other words, a passing wave with a frequency f in a range of about 2 THz to less than about 1300 THz experiences an ENZ medium when the wave passes through the EMNZ metamaterial. In frequencies larger than about 1300 THz, however, effective permittivity $\epsilon_r$ of the EMNZ metamaterial increases. As a result, the EMNZ metamaterial does not exhibit ENZ characteristics in frequencies larger than about 1300 THz.

Figure 9:
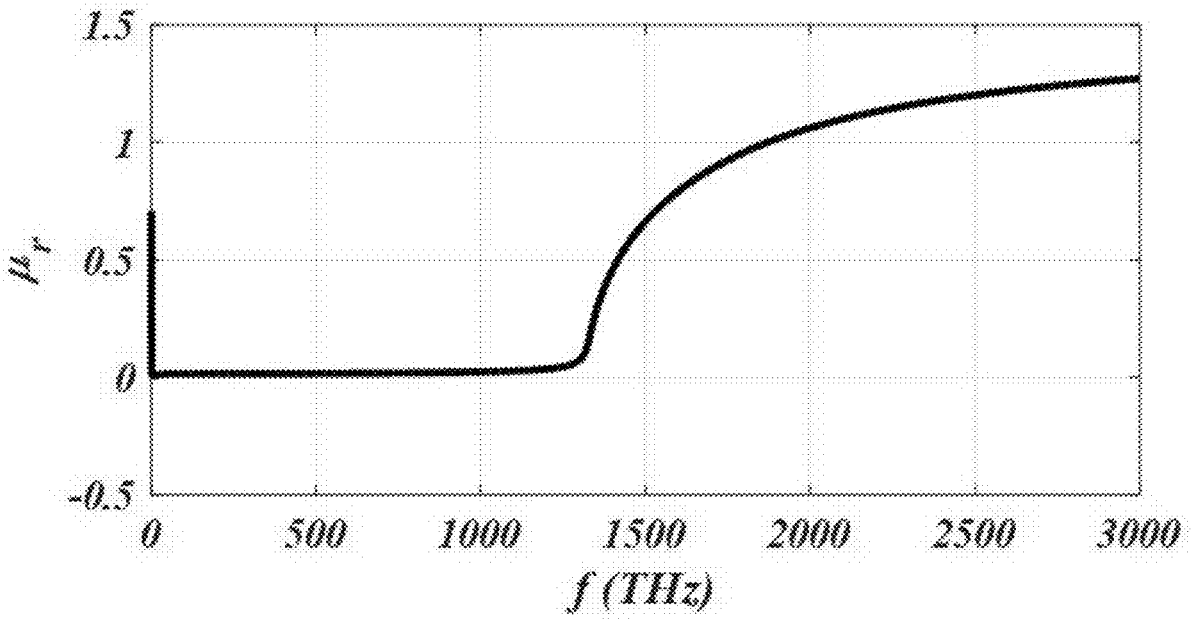
FIG. 9 shows an effective permeability of an EMNZ metamaterial in a visible light frequency range, consistent with one or more exemplary embodiments of the present disclosure.

FIG. 9 shows an effective permeability of an EMNZ metamaterial in a visible light frequency range, consistent with one or more exemplary embodiments of the present disclosure. An exemplary effective permeability $\mu_r$ of the EMNZ metamaterial decreases from more than 0.5 to about 0 in a very narrow frequency range (from 0 to about 2 THz, demonstrated by an almost vertical line at the left edge of the diagram of FIG. 9), and remains about zero in frequencies less than about 1300 THz. In other words, a passing wave with a frequency f in a range of about 2 THz to less than about 1300 THz experiences an MNZ medium when passes through the EMNZ metamaterial. In frequencies larger than about 1300 THz, however, effective permeability $\mu_r$ of the EMNZ metamaterial increases. As a result, the EMNZ metamaterial does not exhibit MNZ characteristics in frequencies larger than about 1300 THz.

EXAMPLE 3

In this example, a performance of a method (similar to method 100) for adjusting a cutoff frequency of an EMNZ metamaterial (similar to EMNZ metamaterial 200) in a gigahertz frequency range is demonstrated. Different steps of the method are implemented utilizing an EMNZ metamaterial similar to EMNZ metamaterial 200. The EMNZ metamaterial includes a graphene-loaded waveguide (similar to graphene-loaded waveguide 202E). The EMNZ metamaterial includes a magneto-dielectric material (similar to magneto-dielectric material 204) with a permittivity about $\epsilon$=2. A length l of the graphene-loaded waveguide (similar to length l) is about l=0.2 mm. A height of the graphene-loaded waveguide (similar to distance $\alpha$) is about $\alpha$=16 mm. A chemical potential (similar to chemical potential $\mu_c$) of a graphene monolayer (similar to graphene monolayer 210) is about 0.6 eV.

Figure 10:
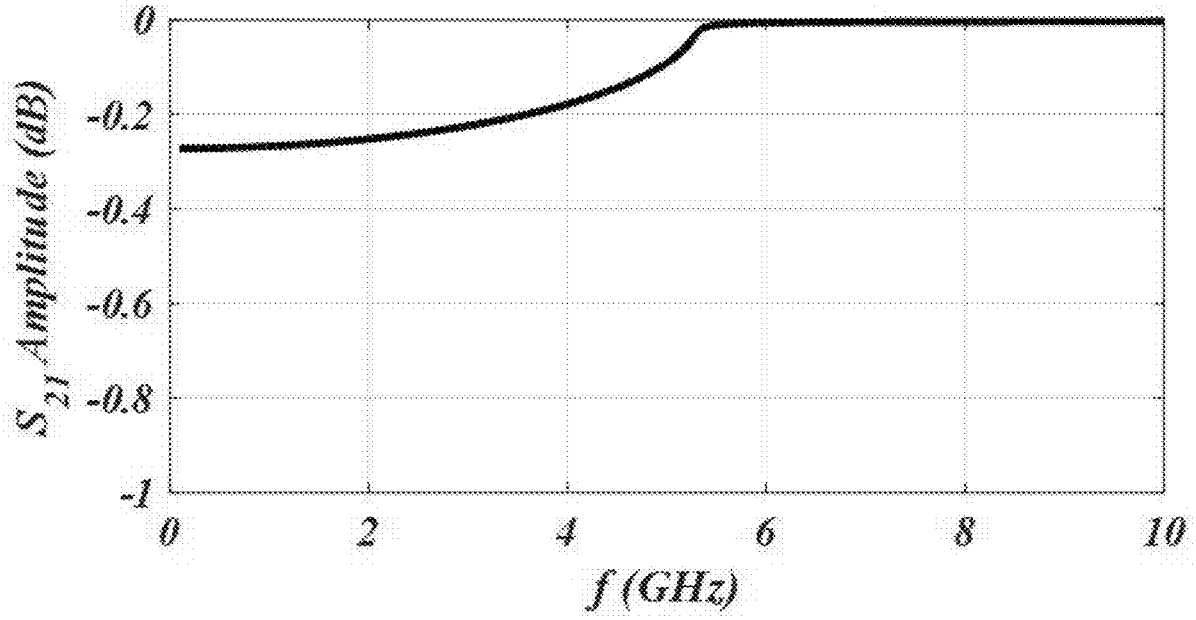
FIG. 10 shows an insertion loss of an EMNZ metamaterial in a gigahertz frequency range, consistent with one or more exemplary embodiments of the present disclosure.

FIG. 10 shows an insertion loss of an EMNZ metamaterial in a gigahertz (GHz) frequency range, consistent with one or more exemplary embodiments of the present disclosure. Amplitude variations of an insertion loss $S_{21}$ of the EMNZ metamaterial in different frequencies are depicted in decibels (dB) in FIG. 10. An exemplary cutoff frequency (similar to cutoff frequency $f_c$) of the EMNZ metamaterial is about 5 GHz. An insertion loss of the EMNZ metamaterial is less than about 0.3 dB in frequencies less than about 5 GHz. As a result, a passing wave with a frequency f less than about 5 GHz may pass through the EMNZ metamaterial with a low amount of energy dissipation.

Figure 11:
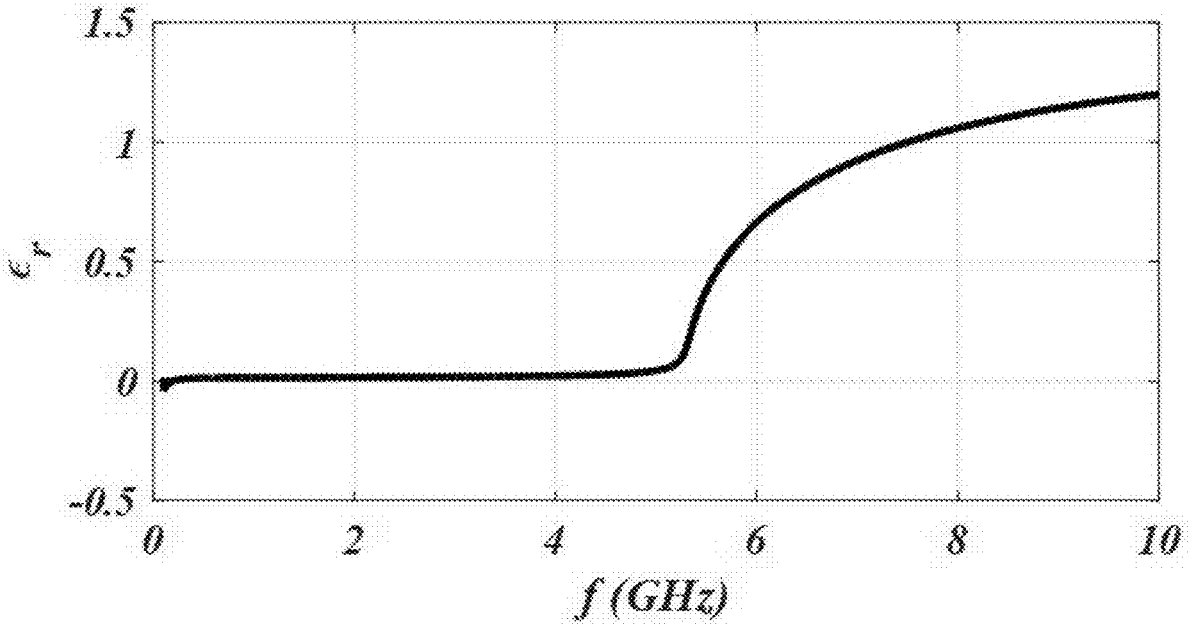
FIG. 11 shows an effective permittivity of an EMNZ metamaterial in a gigahertz frequency range, consistent with one or more exemplary embodiments of the present disclosure.

FIG. 11 shows an effective permittivity of an EMNZ metamaterial in a gigahertz (GHz) frequency range, consistent with one or more exemplary embodiments of the present disclosure. An exemplary effective permittivity $\epsilon_r$ of the EMNZ metamaterial is about to zero in frequencies less than about 5 GHz. In other words, a passing wave with a frequency f less than about 5 GHz experiences an ENZ medium when the wave passes through the EMNZ metamaterial. In frequencies larger than about 5 GHz, however, effective permittivity $\epsilon_r$ of the EMNZ metamaterial increases. As a result, the EMNZ metamaterial does not exhibit ENZ characteristics in frequencies larger than about 5 GHz.

Figure 12:
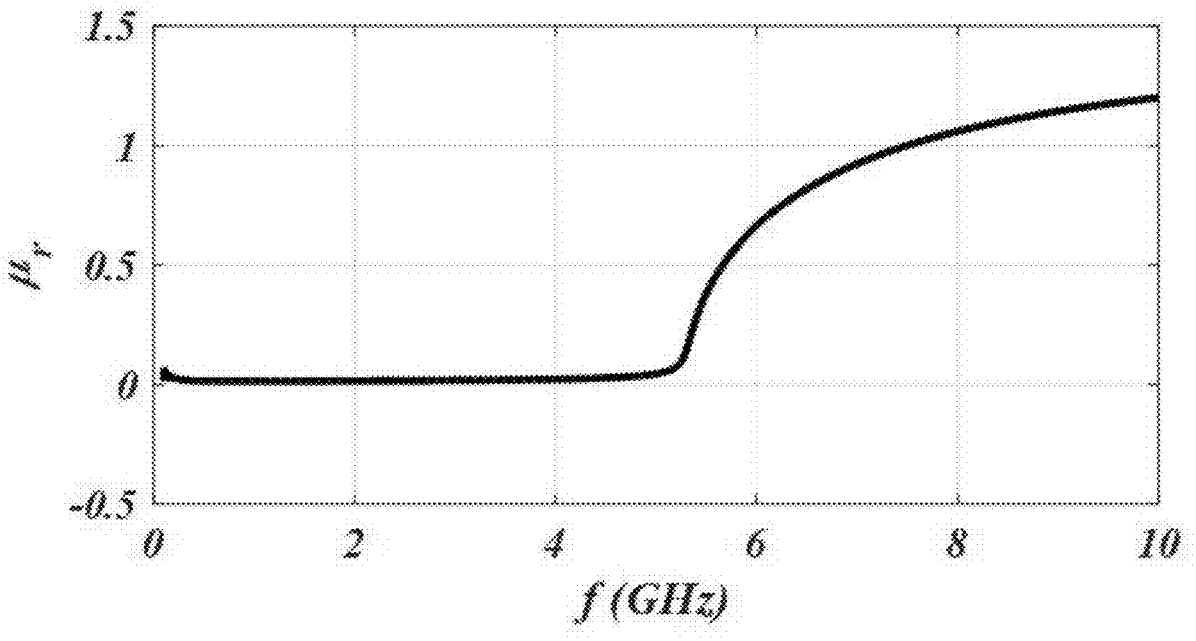
FIG. 12 shows an effective permeability of an EMNZ metamaterial in a gigahertz frequency range, consistent with one or more exemplary embodiments of the present disclosure.

FIG. 12 shows an effective permeability of an EMNZ metamaterial in a gigahertz (GHz) frequency range, consistent with one or more exemplary embodiments of the present disclosure. An exemplary effective permeability $\mu_r$ of the EMNZ metamaterial is about to zero in frequencies less than about 5 GHz. In other words, a passing wave with a frequency f less than about 5 GHz experiences an MNZ medium when passes through the EMNZ metamaterial. In frequencies larger than about 5 GHz, however, effective permeability $\mu_r$ of the EMNZ metamaterial increases. As a result, the EMNZ metamaterial does not exhibit MNZ characteristics in frequencies larger than about 5 GHz.

EXAMPLE 4

In this example, a performance of a method (similar to method 100) for adjusting a cutoff frequency of an EMNZ metamaterial (similar to EMNZ metamaterial 200) is demonstrated. Different steps of the method are implemented utilizing an EMNZ metamaterial similar to EMNZ metamaterial 200. The EMNZ metamaterial includes a graphene-loaded waveguide (similar to graphene-loaded waveguide 202E). The EMNZ metamaterial includes a magneto-dielectric material (similar to magneto-dielectric material 204) with a permittivity about $\epsilon$=2. A length l of the graphene-loaded waveguide (similar to length l) is about l=0.1 μm. A height of the graphene-loaded waveguide (similar to distance $\alpha$) is about $\alpha$=4 μm. An insertion loss, an effective permittivity, and an effective permeability of the EMNZ metamaterial is obtained for different values of a chemical potential (similar to chemical potential $\mu_c$) of a graphene monolayer (similar to graphene monolayer 210). The chemical potential is set to about 0 eV and 0.6 eV.

Figure 13:
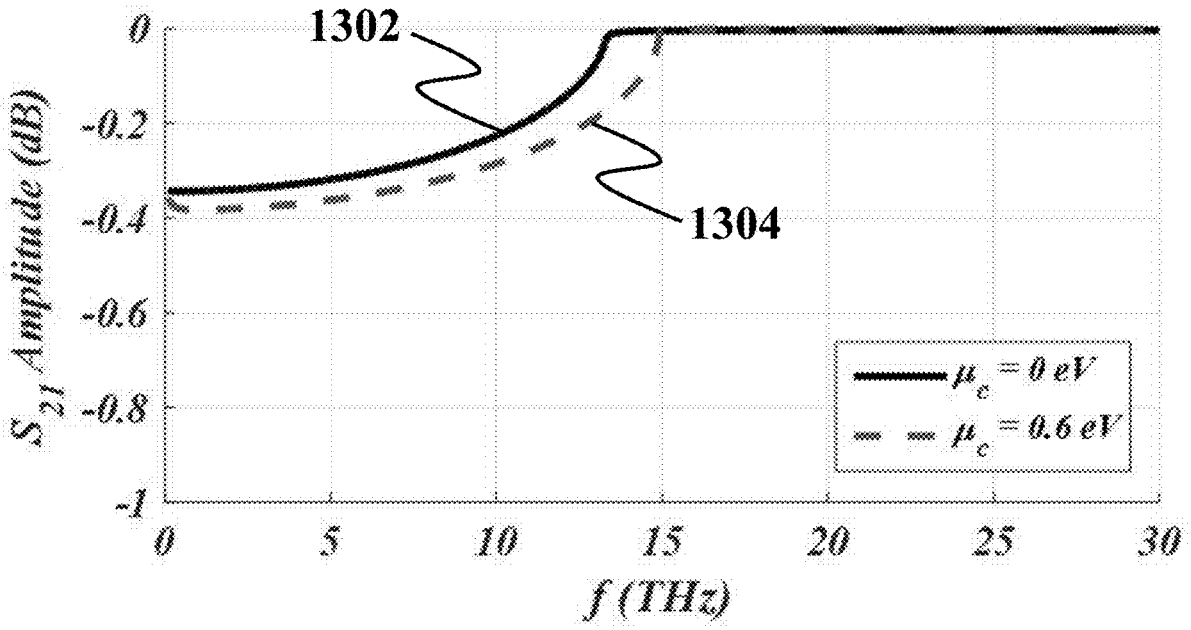
FIG. 13 shows an insertion loss of an EMNZ metamaterial for different values of a chemical potential, consistent with one or more exemplary embodiments of the present disclosure.

FIG. 13 shows an insertion loss of an EMNZ metamaterial for different values of a chemical potential, consistent with one or more exemplary embodiments of the present disclosure. Amplitude variations of an insertion loss $S_{21}$ of the EMNZ metamaterial at different frequencies f(GHz) are depicted in decibels (dB) in FIG. 13. An insertion loss 1302 depicts an insertion loss of the EMNZ metamaterial with chemical potential $\mu_c$ of 0 eV. An insertion loss 1304 depicts an insertion loss of the EMNZ metamaterial with chemical potential $\mu_c$ of 0.6 eV. An exemplary cutoff frequency (similar to cutoff frequency $f_c$) of the EMNZ metamaterial is about 15 THz when the chemical potential is set to about 0.6 eV. An exemplary cutoff frequency of the EMNZ metamaterial is about 13 THz when the chemical potential is set to about 0 eV. As a result, the cutoff frequency of the EMNZ metamaterial is adjusted by changing a value of the chemical potential of the graphene monolayer.

While the foregoing description has described what may be considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations. This is for purposes of streamlining the disclosure, and is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

While various implementations have been described, the description is intended to be exemplary, rather than limiting and it will be apparent to those of ordinary skill in the art that many more implementations and implementations are possible that are within the scope of the implementations. Although many possible combinations of features are shown in the accompanying figures and discussed in this detailed description, many other combinations of the disclosed features are possible. Any feature of any implementation may be used in combination with or substituted for any other feature or element in any other implementation unless specifically restricted. Therefore, it will be understood that any of the features shown and/or discussed in the present disclosure may be implemented together in any suitable combination. Accordingly, the implementations are not to be restricted except in light of the attached claims and their equivalents. Also, various modifications and changes may be made within the scope of the attached claims.

What is claimed is:

1. An epsilon-and-mu-near-zero (EMNZ) metamaterial, comprising:

a waveguide, a length l of the waveguide satisfying a condition according to $l \leq 0.1\lambda$, where $\lambda$ is an operating wavelength of the EMNZ metamaterial, the waveguide comprising one of a rectangular waveguide and a parallel-plate waveguide;

a magneto-dielectric material deposited on a lower wall of the waveguide;

a graphene monolayer placed on the magneto-dielectric material, the graphene monolayer attached to a left sidewall of the rectangular waveguide and a right sidewall of the rectangular waveguide; and a dielectric spacer coated on the graphene monolayer and attached to an upper wall of the waveguide, wherein:

a thickness h of the dielectric spacer satisfies a condition according to $$h \leq \frac{\lambda}{4};$$

a permittivity of the dielectric spacer is equal to a permittivity $\epsilon$ of the magneto-dielectric material; and a permeability of the dielectric spacer is equal to a permeability $\mu$ of the magneto-dielectric material;

wherein a cutoff frequency $f_c$ of the EMNZ metamaterial is configured to be adjusted by adjusting a chemical potential $\mu_c$ of the graphene monolayer according to an operation defined by:

$$f_c = \frac{1}{4a\sqrt{\mu\epsilon_{eff}}}$$

where:

$\alpha$ is a distance between the upper wall and a lower wall of the waveguide, and $\epsilon_{eff}$ is an effective permittivity of the magneto-dielectric material and the graphene monolayer, where $\epsilon_{eff} = \epsilon(1-165\sqrt{\alpha}\mu_c)$.

2. An epsilon-and-mu-near-zero (EMNZ) metamaterial, comprising a waveguide, a length l of the waveguide satisfying a length condition according to $l \leq 0.1\lambda$, where $\lambda$ is an operating wavelength of the EMNZ metamaterial.

3. The EMNZ metamaterial of claim 2, wherein the waveguide comprises one of a rectangular waveguide and a parallel-plate waveguide.

4. The EMNZ metamaterial of claim 3, further comprising a magneto-dielectric material deposited on a lower wall of the waveguide.

5. The EMNZ metamaterial of claim 4, wherein the waveguide further comprises an impedance surface placed on the magneto-dielectric material.

6. The EMNZ metamaterial of claim 5, wherein the impedance surface comprises a tunable impedance surface comprising a tunable conductivity.

7. The EMNZ metamaterial of claim 6, wherein the tunable impedance surface comprises a graphene monolayer.

8. The EMNZ metamaterial of claim 7, wherein a dielectric spacer is coated on the graphene monolayer and attached to an upper wall of the waveguide, a thickness h of the dielectric spacer satisfying a thickness condition according to $$h \leq \frac{\lambda}{4},$$

a permittivity of the dielectric spacer equal to a permittivity $\epsilon$ of the magneto-dielectric material and a permeability of the dielectric spacer equal to a permeability $\mu$ of the magneto-dielectric material.

9. The EMNZ metamaterial of claim 7, wherein the graphene monolayer is attached to a left sidewall of the rectangular waveguide and a right sidewall of the rectangular waveguide.

10. The EMNZ metamaterial of claim 7, wherein a cutoff frequency $f_c$ of the EMNZ metamaterial is configured to be adjusted by adjusting a chemical potential $\mu_c$ of the graphene monolayer.

11. The EMNZ metamaterial of claim 10, wherein the cutoff frequency $f_c$ is configured to be adjusted according to an operation defined by:

$$f_c = \frac{1}{4a\sqrt{\mu\epsilon_{eff}}}$$

where:

$\alpha$ is a distance between an upper wall and the lower wall of the waveguide, $\mu$ is the permeability of the magneto-dielectric material and $\epsilon_{eff}$ is an effective permittivity of the magneto-dielectric material and the graphene monolayer, where $\epsilon_{eff} = \epsilon(1-165\sqrt{\alpha}\mu_c)$.

12. A method for adjusting a cutoff frequency $f_c$ of an epsilon-and-mu-near-zero (EMNZ) metamaterial, the EMNZ metamaterial comprising a waveguide, the method comprising designing the waveguide by determining a length l of the waveguide based on a length condition defined by $l \leq 0.1\lambda$, where $\lambda$ is an operating wavelength of the EMNZ metamaterial.

13. The method of claim 12, wherein designing the waveguide comprises designing one of a rectangular waveguide and a parallel-plate waveguide.

14. The method of claim 13, further comprising depositing a magneto-dielectric material on a lower wall of the waveguide.

15. The method of claim 14, further comprising placing an impedance surface on the magneto-dielectric material.

16. The method of claim 15, wherein placing the impedance surface on the magneto-dielectric material comprises placing a tunable impedance surface on the magneto-dielectric material, the tunable impedance surface comprising a tunable conductivity.

17. The method of claim 15, wherein placing the tunable impedance surface on the magneto-dielectric material comprises placing a graphene monolayer on the magneto-dielectric material as the tunable impedance surface.

18. The method of claim 17, wherein placing the graphene monolayer on the magneto-dielectric material further comprises:

coating a dielectric spacer on the graphene monolayer, comprising determining a thickness h of the dielectric spacer based on a thickness condition defined by $$h \leq \frac{\lambda}{4};$$

and attaching the dielectric spacer to an upper wall of the waveguide;

wherein a permittivity of the dielectric spacer equals a permittivity $\epsilon$ of the magneto-dielectric material and a permeability of the dielectric spacer equals a permeability $\mu$ of the magneto-dielectric material.

19. The method of claim 17, wherein placing the graphene monolayer further comprises:

attaching the graphene monolayer to a left sidewall of the rectangular waveguide; and attaching the graphene monolayer to a right sidewall of the rectangular waveguide.

20. The method of claim 17, further comprising adjusting a cutoff frequency $f_c$ by adjusting a chemical potential $\mu_c$ of the graphene monolayer according to an operation defined by:

$$f_c = \frac{1}{4a\sqrt{\mu\epsilon_{eff}}}$$

where:

$\alpha$ is a distance between an upper wall and the lower wall of the waveguide, $\mu$ is the permeability of the magneto-dielectric material and $\epsilon_{eff}$ is an effective permittivity of the magneto-dielectric material and the graphene monolayer, where $\epsilon_{eff}=\epsilon(1\text{-}165\sqrt{\alpha}\mu_c)$.

* * * * *